US010549309B2

(12) United States Patent
Kappeler et al.

(10) Patent No.: US 10,549,309 B2
(45) Date of Patent: Feb. 4, 2020

(54) SLOTTED NOZZLE

(71) Applicant: Robatech AG, Muri (CH)

(72) Inventors: Roman Kappeler, Muri (CH); Mathias Heller, Muri (CH)

(73) Assignee: Robatech AG, Muri (CH)

( * ) Notice: Subject to any disclaimer, the term of this patent is extended or adjusted under 35 U.S.C. 154(b) by 29 days.

(21) Appl. No.: 15/934,670

(22) Filed: Mar. 23, 2018

(65) Prior Publication Data

US 2018/0272374 A1 Sep. 27, 2018

(30) Foreign Application Priority Data

Mar. 27, 2017 (EP) ..... 17163097

(51) Int. Cl.

| | |
|---|---|
| ***B05C 5/02*** | (2006.01) |
| ***B05C 11/10*** | (2006.01) |
| ***B05C 11/08*** | (2006.01) |
| ***B05D 1/32*** | (2006.01) |

(52) U.S. Cl.

CPC ..... *B05C 5/0262* (2013.01); *B05C 5/0204* (2013.01); *B05C 5/0254* (2013.01); *B05C 5/0266* (2013.01); *B05C 11/08* (2013.01); *B05C 11/1039* (2013.01); *B05C 11/1013* (2013.01); *B05D 1/325* (2013.01)

(58) Field of Classification Search

USPC ..... 156/538, 547, 549, 550, 578

See application file for complete search history.

(56) References Cited

U.S. PATENT DOCUMENTS

| | | | |
|---|---|---|---|
| 3,595,203 | A | 7/1971 | Fabulich |
| 5,976,256 | A | 11/1999 | Kawano |
| 6,053,978 | A | 4/2000 | Bernert |
| 6,319,316 | B1 | 11/2001 | Gibson et al. |
| 2012/0085282 | A1 | 4/2012 | Ikagawa et al. |
| 2012/0219657 | A1 | 8/2012 | Kondo |
| 2013/0236651 | A1 | 9/2013 | Komatsubara et al. |
| 2015/0165470 | A1 | 6/2015 | Kuniyasu et al. |
| 2017/0066231 | A1 | 3/2017 | DeFillipi et al. |

*Primary Examiner* — Sing P Chan

(74) *Attorney, Agent, or Firm* — Christopher C. Dremann, P.C.; Christopher C. Dremann

(57) ABSTRACT

A slotted nozzle for discharging a liquid adhesive to a narrow edge of a substrate includes a nozzle body, a nozzle slot formed in the nozzle body, a passage in the nozzle body for supplying the adhesive to the nozzle slot, and a slot-shaped outlet opening of the nozzle slot. The nozzle body is configured in the region of averted ends of the nozzle slot that are based on the longitudinal extent of the nozzle slot in such a manner that an increased outlet of the adhesive through the outlet opening takes place in the region of the averted ends of the nozzle slot.

16 Claims, 8 Drawing Sheets

Prior art

SLOTTED NOZZLE

CROSS REFERENCE TO RELATED APPLICATION

This U.S. non-provisional utility patent application claims the benefit of priority to European Patent Application No. EP 17 163 097.3 filed on Mar. 27, 2017, the entire disclosure of which is incorporated herein by reference.

FIELD OF THE INVENTION

The present invention relates to a slotted nozzle for discharging a liquid adhesive, in particular for applying adhesive to a narrow edge of a substrate for the purpose of adhesive bonding to an edge band.

BACKGROUND OF THE INVENTION AND RELATED ART

Panels made of wood or wood-containing material are used nowadays in a very wide variety of applications. In order that the panels have a pleasing appearance and are adaptable to the use requirements, a flexible edge band is frequently adhesively bonded over the narrow edges, and flexible cover panels or cover bands are frequently adhesively bonded over the large areas. For example, kitchen or bathroom furniture is very frequently manufactured from such panels.

Edge banders are available for producing panels of this type. There are machines which are capable of providing the large area of the panels with cover panels or cover bands, and there are machines which are provided for only providing the narrow edges with the edge band. Machines which can carry out both processes are also known.

An apparatus for applying adhesive to a substrate is known from practice, comprising an application roller which is rotatable about an axis, a device for discharging adhesive onto a circumferential surface of the application roller, a dispensing region of the application roller for dispensing adhesive from the application roller onto the substrate, and a stripping blade, wherein the dispensing region for adhesive is arranged behind the device for discharging the adhesive onto the application roller and in front of the stripping blade in the direction of rotation of the application roller.

The device for dispensing adhesive onto the circumferential surface of the application roller is a slotted nozzle. Adhesive is applied to the application roller with the slotted nozzle in a width which corresponds to the thickness of the substrate. The length of the adhesive application to the application roller (circumferential length) corresponds to the length of the substrate multiplied by a multiplication factor. With this apparatus, it is possible to deposit only the amount of adhesive on the application roller that is required for complete gluing of the narrow edge of the substrate. The adhesive is virtually completely transferred here from the application roller onto the substrate, and only very little residual adhesive arises which has to be removed from the application roller with the stripping blade.

In the case of such a device, the application of adhesive to the substrate starts, as viewed above a line in the direction of the thickness of the substrate, with an increase to the thickness of the adhesive film and ends with a decrease in the thickness of the adhesive film toward the end of the substrate thickness. If the edge band is placed against the substrate which is provided with adhesive, less adhesive is present in the region of the increase and of the decrease, and a visible gap arises between edge band and substrate. This is not acceptable for a pleasing appearance of the coated substrate. Instead of or in addition to the gap, interruptions in the adhesive (adhesive holes) may also be visible between edge band and substrate. The interruptions in the adhesive become more greatly visible whenever the substrate is additionally painted, and water may penetrate into the substrate through said interruptions in the adhesive. These negative effects can be virtually eliminated by an application of adhesive to the application roller, the application of adhesive being slightly wider than the thickness of the substrate. However, this has the disadvantage that more adhesive has to be removed with the stripping blade and disposed of. This increases the consumption of adhesive. This also results in higher production costs and more material which is to be disposed of.

In the event of a prolonged shutdown of the edge bander, the application of adhesive to the first substrate with the apparatus is incomplete after the system is restarted. This is because the liquid adhesive runs slowly downward due to gravity in the vertically oriented slotted nozzle and, in the event of a prolonged shutdown of the system, emerges from the outlet opening in the slotted nozzle. The adhesive which has emerged is replaced in the upper region of the outlet opening by an air cushion of identical volume. The volume of the adhesive which has emerged is dependent, alongside the time, primarily on the viscosity and the geometry of the slot-shaped outlet opening of the slotted nozzle. If the edge bander is started again after a prolonged shutdown time, adhesive is lacking in the upper region during the first application of adhesive from the slotted nozzle onto the application roller, and the application of adhesive at the start of the substrate is incomplete.

The last-mentioned disadvantage is eliminated in the case of the apparatus known from practice by means of the controller of said apparatus. The controller of the apparatus has information about when a substrate is supplied. If there is an interruption in production and a substrate is not supplied, the controller starts a settable counter. If the counter has run down and no substrate has been supplied, the controller activates the flow of glue through the slotted nozzle for a brief time as soon as the controller establishes that a substrate is being supplied again. This takes place before the substrate comes into contact with the application roller for the gluing. As a result, the part filled with air in the slotted nozzle is replaced with adhesive, and a little adhesive is dispensed onto the application roller. Since said adhesive does not come into contact with the substrate, it is stripped off by the stripping blade and disposed of.

Furthermore, a slotted nozzle is known from practice in conjunction with spine coat solutions for PUR adhesive bonding of a book spine, at which slotted nozzle the slot length of the nozzle can be set in accordance with the thickness of the book spine to be adhesively bonded. The slotted nozzle has an outlet opening and a first bore running in parallel at a distance below said opening. In said first bore, a plunger rod, to which a tab which engages in the slot of the nozzle is fastened, is movable in the direction of the first bore. It forms the adjustable end of the slot length on the slotted nozzle in that the tab and the plunger are sealed off from the adhesive. The adhesive which is supplied through a second bore, which opens on the side opposite the plunger rod into the first bore, flows over the free length of the first bore and out of the slotted nozzle through the free slot when the flow of adhesive through the slotted nozzle is activated. A slotted nozzle of this type can also be used on the apparatus for gluing the narrow edge of a substrate on an edge bander. However, the previously described disadvantages occur here.

The last-mentioned slotted nozzle therefore has a nozzle body, a nozzle slot formed in the nozzle body, a passage in the nozzle body for supplying the adhesive to the nozzle slot, and a slot-shaped outlet opening of the nozzle slot.

OBJECTS AND SUMMARY OF THE INVENTION

It is an object of the present invention to develop a slotted nozzle of the type mentioned in such a manner that an application of adhesive can be achieved by means of the slotted nozzle, the application of adhesive, after the fitting and pressing on of the component to be connected to the substrate, in particular an edge band, having a virtually rectangular cross-sectional shape between the edge band and the substrate, as seen perpendicularly to the longitudinal extent of the component or edge band.

The object is achieved by a slotted nozzle which is formed in accordance with the exemplary embodiments of the invention described herein and shown in the accompanying drawing figures.

In the case of a slotted nozzle according to the invention, the nozzle body is configured in the region of averted ends of the nozzle slot, wherein said ends are based on the longitudinal extent of the nozzle slot, in such a manner that an increased outlet of the adhesive through the outlet opening takes place in the region of the averted ends of the nozzle slot.

In the case of a slotted nozzle according to the invention, as before, an application of adhesive to the substrate takes place, as viewed above a line in the direction of the thickness of the substrate, starting with an increase to the thickness of the adhesive film and ending with a decrease in the thickness of the adhesive film toward the end of the substrate. However, in the case of a slotted nozzle according to the invention, the region of increase is undertaken with a slightly overincreased thickness of the adhesive film, and the decrease in the thickness of the adhesive film starts from a slightly increased thickness of the adhesive film. Between said increased thicknesses of the adhesive film at the end of the increase and at the beginning of the decrease, the adhesive is applied with the normal thickness of the adhesive film. When the component or edge band is fitted and pressed onto the substrate, no visible gaps arise between component and substrate because the increasing and decreasing regions of adhesive have been filled up by the adhesive from the increased regions.

A slotted nozzle according to the invention is customarily designed in such a manner that the nozzle body forms closing edges in the region of the averted ends of the nozzle slot. Said closing edges therefore bound the nozzle slot, in the region of the averted ends, with respect to the adhesive located in the nozzle slot.

According to an advantageous development of the slotted nozzle, it is provided that owing to a reduction in the flow cross section of the nozzle body toward an outlet opening, which has a constant width, an increased outlet of the adhesive through the outlet opening in the region of the averted ends of the nozzle slot is produced. The outlet opening therefore has a constant width over its entire length. Since, based on the discharging direction of the adhesive, the flow cross section of the nozzle body tapers toward the outlet opening, a slightly larger quantity of adhesive emerges from the slotted nozzle in the region of the averted ends of the nozzle slot than between said averted ends.

In this embodiment, it is considered further advantageous if the nozzle body is configured in the region of the averted ends of the nozzle slot in such a manner that the flow cross section of the nozzle body is continuously reduced toward the outlet opening.

In this further embodiment, the two closing edges in particular each have a shape not running perpendicularly to the outlet opening. For example, a curved shape or a rectilinear shape may be involved. In particular, it is provided that the two closing edges have an identical shape arranged in a mirror-inverted manner.

According to another advantageous embodiment of the invention, it is provided that the outlet opening has a greater width extent in the region of the averted ends of the nozzle slot than in the remaining region of the outlet opening, which region has a constant width. Since the passage cross section for adhesive through the outlet opening of the nozzle slot is greater in the region of the averted ends of the nozzle slot than in that region of the outlet opening which lies between said averted ends of the nozzle slot, the increased application of the adhesive to the substrate can likewise be brought about.

In this embodiment, the nozzle body in each case has an expansion of the outlet opening in particular in the region of the two closing edges, in those regions of the outlet opening which are adjacent to said closing edges, with the width of the outlet opening otherwise being constant. Based on the width extent of the outlet opening, said expansion in the region of the respective closing edge can be provided only on one side of the outlet opening or on the two opposite sides of the outlet opening.

According to yet another advantageous embodiment of the invention, it is provided that the nozzle body is of tapering design toward the outlet opening in the region of one of the averted ends of the nozzle slot, and the outlet opening has a greater width in comparison to the outlet opening which has an otherwise constant width in the region of the other end of the averted ends of the nozzle slot. This configuration therefore constitutes a combination of the two advantageous embodiments previously discussed. In this configuration, it is provided in particular that one of the two closing edges has a curved shape, and the nozzle body has an expansion of the outlet opening in the region of the other closing edge, in that region of the outlet opening which is adjacent to said closing edge, with the width of the outlet opening otherwise being constant. The excessively increased application of adhesive in the region of the two closing edges previously described in principle can also be achieved by means of this configuration.

According to a particular embodiment of the invention, the slotted nozzle is designed in such a manner that the length of the nozzle slot and of the outlet opening is adjustable. In particular, the length of the nozzle slot and of the outlet opening is adjustable by an adjustment part which is arranged displaceably in the nozzle body and passes through the nozzle slot. In this manner, the adjustment of the length of the outlet opening of the nozzle body with simultaneous adjustment of the length of the nozzle slot is possible with a structurally very simple configuration.

In particular, the adjustable slotted nozzle is designed in such a manner that a rod which is mounted displaceably in the nozzle part and is adjustable accommodates the adjustment part in the region of a free end. Said adjustment part is designed in particular as a plate-like tab. The one closing edge is preferably integrated in the adjustment part. The adjustment part has the one closing edge on its side facing that region of the nozzle slot which receives the medium.

In the case of a non-adjustable slotted nozzle, the nozzle body can be configured as a single part throughout. In the case of an adjustable slotted nozzle, the nozzle body has a single- or multi-part basic body and an adjustment part. In this case, the length of the nozzle slot and of the outlet opening is adjustable by the adjustment part which is mounted displaceably in the basic body and passes through the nozzle slot.

A slotted nozzle together with the features thereof is therefore proposed, with which an application of adhesive to a substrate in the direction of the substrate thickness has a virtually rectangular cross-sectional shape after fitting and pressing of a component, in particular an edge band, and, as a result, the substrate, after being provided with the component or with the edge band, has an attractive appearance.

The slotted nozzle can be used in particular in an apparatus for applying adhesive to a substrate, comprising an application roller which is rotatable about an axis, wherein the slotted nozzle serves for discharging adhesive onto a circumferential surface of the application roller, further comprising a dispensing region of the application roller for dispensing adhesive from the application roller to the substrate, and further comprising a stripping blade, wherein the dispensing region for adhesive is arranged behind the slotted nozzle for discharging the adhesive onto the application roller and in front of the stripping blade in the direction of rotation of the application roller, and in which the slotted nozzle is capable of realizing an application of adhesive to the application roller in the direction of the adhesive application width (axial direction of the application roller), said application of adhesive starting with an excessive accumulation and ending with an excessive accumulation.

Other objects and features of the invention will be apparent to those skilled in the art from the following detailed description of exemplary embodiments of the invention and the accompanying drawing figures, wherein it is noted that all of the individual features and all of the combinations of individual features are applicable to the invention.

BRIEF DESCRIPTION OF THE DRAWING FIGURES

In the accompanying drawing figures, the invention is illustrated with reference to exemplary embodiments without being restricted to said exemplary embodiments.

DETAILED DESCRIPTION OF EXEMPLARY EMBODIMENTS OF THE INVENTION

Figure 1:
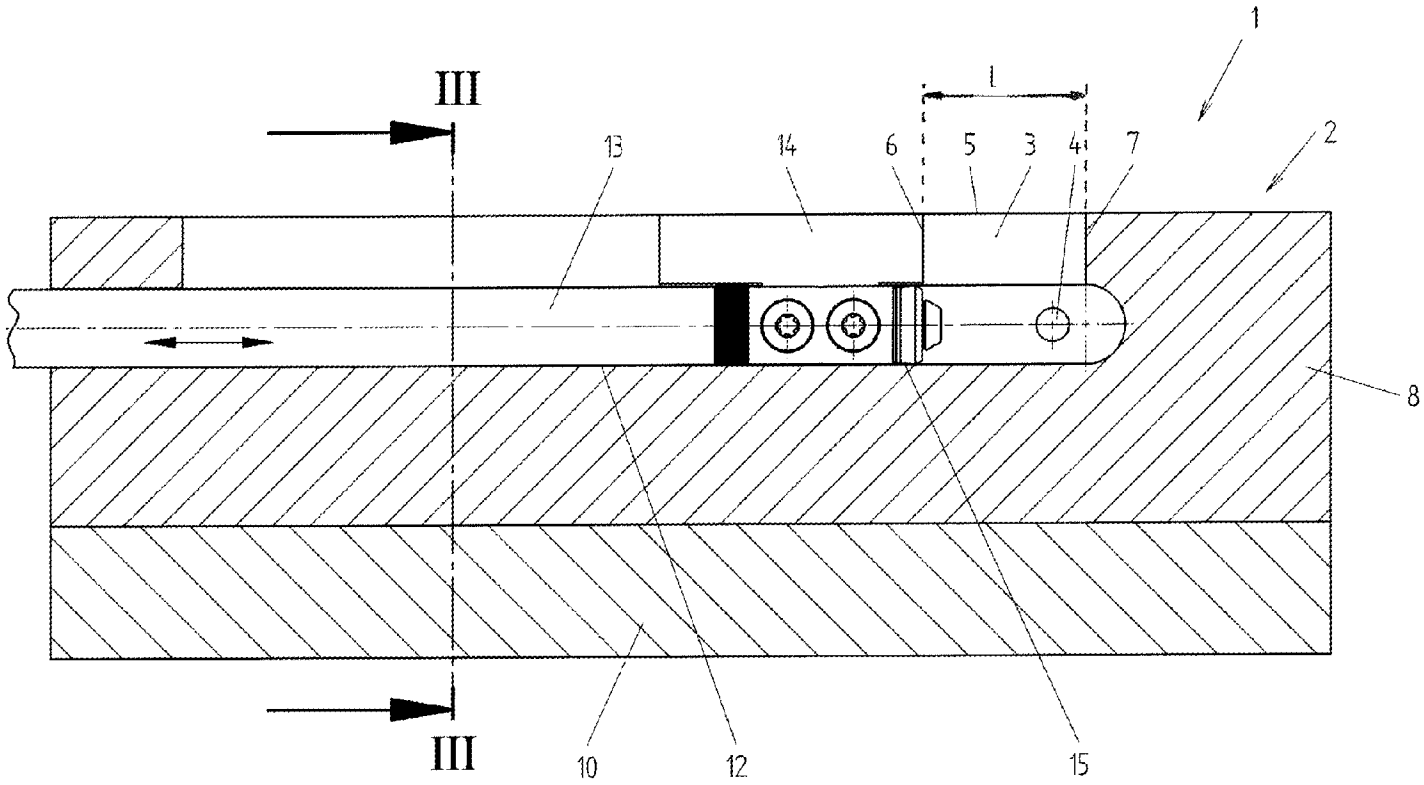
Prior art Fig. 1
FIG. 1 shows the prior art, namely a section through a nozzle part of an adjustable slotted nozzle for discharging liquid adhesive according to the line I-I in FIG. 3, with a plunger rod and a tab for adjusting an outlet opening of the slotted nozzle.
Figure 2:
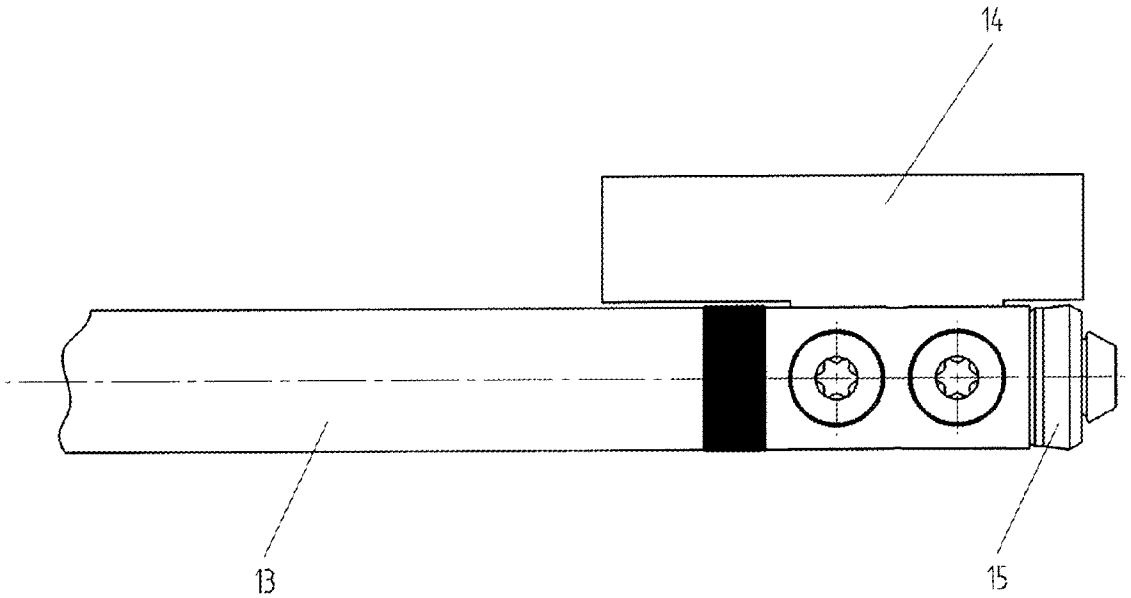
Prior art Fig. 2
FIG. 2 shows the prior art, namely relating to FIG. 1, in a side view of the disassembled plunger rod with tab.
Figure 3:
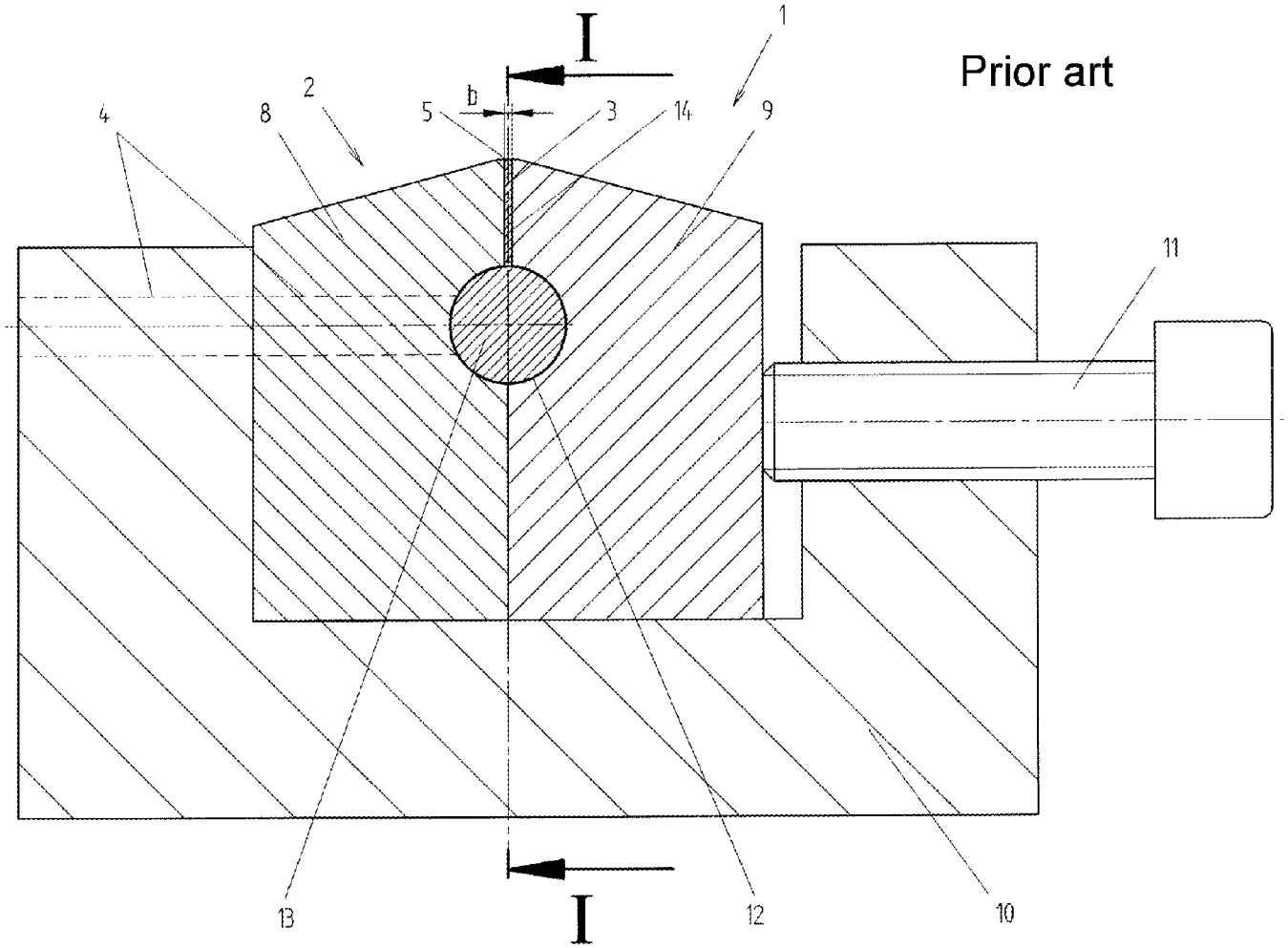
FIG. 3 shows the prior art, namely a section through the slotted nozzle according to the line III-III in FIG. 1.

FIGS. 1 to 3 show a nozzle part of a slotted nozzle 1 according to the prior art. The slotted nozzle 1 serves for discharging liquid adhesive. The slotted nozzle 1 has a nozzle body 2, a nozzle slot 3 formed in the nozzle body 2, a passage 4 in the nozzle body 2 for supplying the adhesive to the nozzle slot 3, and a slot-shaped outlet opening 5 of the nozzle slot 3. Averted ends of the nozzle slot 3 are indicated by the reference signs 6 and 7. The length of the nozzle slot 3 and the length of the outlet opening 5 is indicated by the dimension l, and the width in each case by the dimension b.

The length l of the nozzle slot is adjustable. Adhesive can emerge from the slotted nozzle 1 through the nozzle slot 3 and the outlet opening 5. The outlet opening 5 is rectangular. By adjustment of the slotted nozzle 1, the length extent of nozzle slot 3 and outlet opening 5 can be changed, while the width extent of nozzle slot 3 and outlet opening 5 is unchanged.

A first nozzle part 8 and a second nozzle part 9 of the nozzle body 2 are held together by a fastening body 10 by means of adjusting screws 11. A bore 12 is provided centrally through the two nozzle parts 8, 9 somewhat below the outlet opening 5 of the slotted nozzle 1. Located in said bore is a plunger rod 13 with a tab 14 which is fastened thereto and projects into the nozzle slot 3 between the bore 12 and the outlet opening 5. A plunger seal 15 is located on the plunger rod 13, said plunger seal separating that space of the bore 12 and of the nozzle slot 3 which is fillable with adhesive from that space of the bore 12 and of the nozzle slot 3 which is not fillable with adhesive. Adhesive can be conveyed through the passage 4, which is designed as a further bore, into the bore 12 and the nozzle slot 3 and can then emerge at the outlet opening 5 of the slotted nozzle 1. The length of the nozzle slot 3 and of the outlet opening 5 can be changed by displacement of the plunger rod 13 with the tab 14 in the direction of the longitudinal extent of the bore 12.

Figure 4:
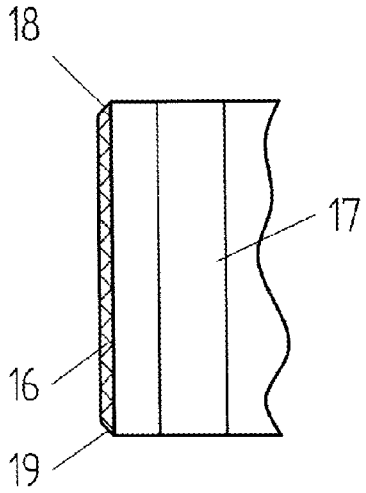
Fig: 4 Prior art
FIG. 4 shows an application of adhesive applied to a substrate by means of the slotted nozzle with respect to the prior art in FIGS. 1-3.
Figure 5:
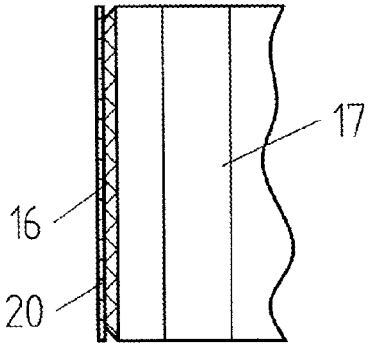
FIG. 5 shows an application of adhesive applied to a substrate by means of the slotted nozzle, with respect to the prior art in FIGS. 1-3, after the fitting and pressing of an edge band.

With a slotted nozzle 1 according to this prior art, an application 16 of adhesive to an edge of the substrate 17, as illustrated in FIG. 4, can be produced with the apparatus for fitting an edge band in an edge bander. In the application of adhesive, which is indicated somewhat thicker than the thickness customary in practice for better visibility, the increase 18 and decrease 19 of the application 16 of adhesive at the edges of the substrate 17 is readily visible. If the edge band 20 is fitted, the pressing power against the edge band 20 is not capable of deforming the application of adhesive, and an annoying visible gap arises at the two substrate corner edges, as illustrated in FIG. 5.

Figure 6:
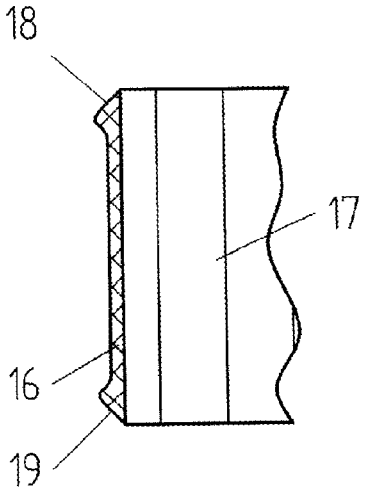
FIGS. 6 and 7 show illustrations which correspond to the illustrations in FIGS. 4 and 5, but during application of an adhesive to the substrate by means of a slotted nozzle configured according to the invention.
Figure 7:
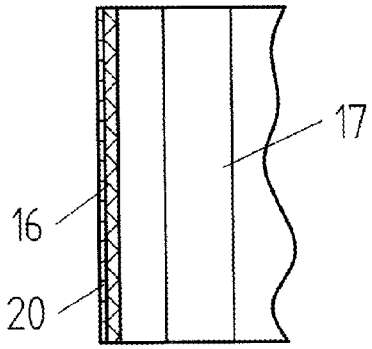

The invention presents a slotted nozzle 1 with which it is possible to slightly over-increase the application 16 of adhesive to the substrate 17 by way of the increase 18 and the decrease 19, as illustrated in FIG. 6. If the edge band 20 is applied and pressed on, the boosting of the adhesive by way of the increase 18 and at the decrease 19 of the application 16 of adhesive is deformed and fills the region of increase and decrease with adhesive. This is shown in FIG. 7. The annoying visible gap is no longer present. In this embodiment, the application of adhesive can be deformed because the over-increase in adhesive is only partially applied and, when the edge band is pressed on, the entire pressing force acts on the two over-increases in adhesive. Since adhesive is uncompressible, the adhesive is displaced toward the corners of the application of the adhesive.

Figure 8:
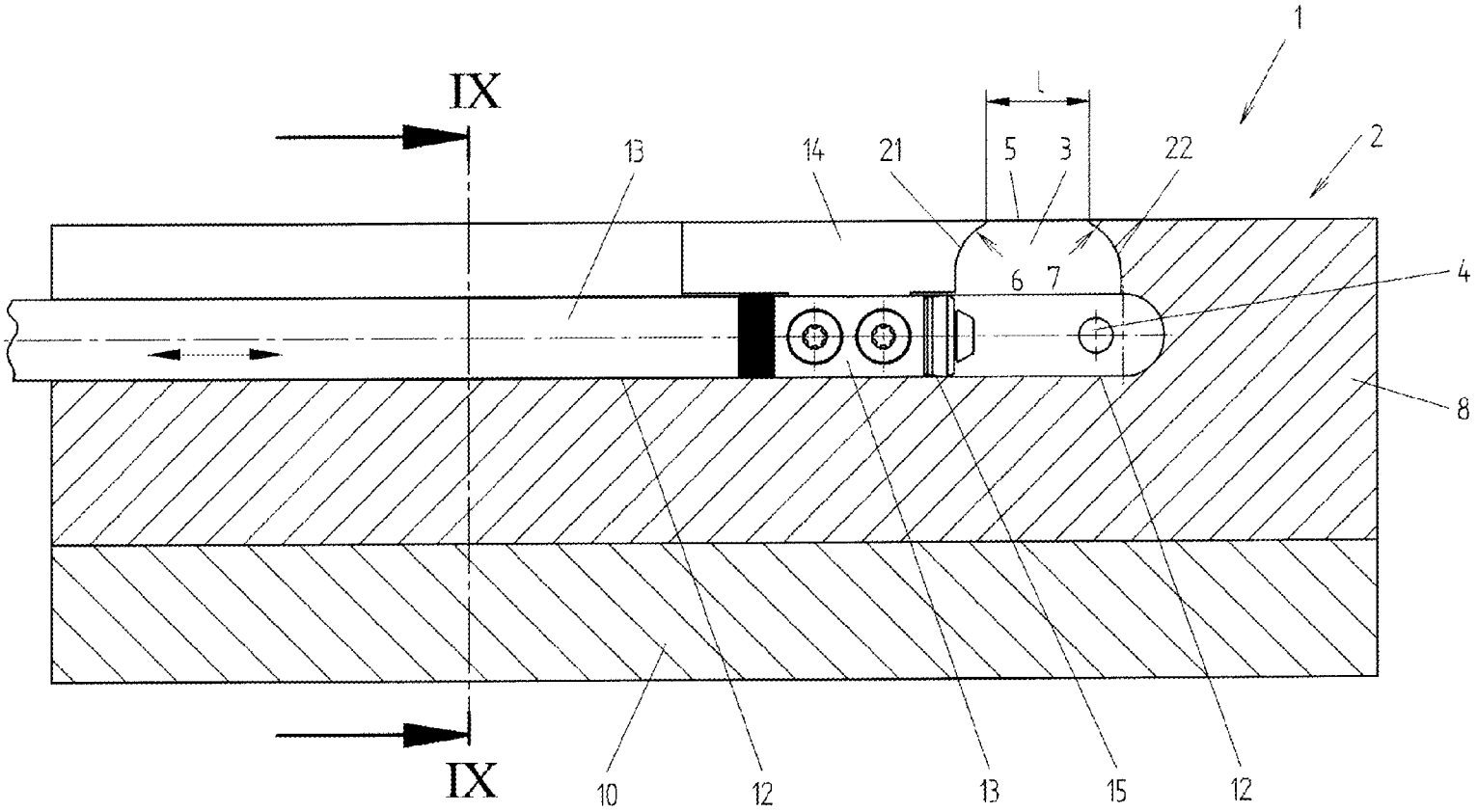
FIG. 8 shows, for a first exemplary embodiment of the slotted nozzle according to the invention, a section through the nozzle part of the adjustable slotted nozzle according to the line VIII-VIII in FIG. 9, corresponding to the sectional illustration with respect to the prior art according to FIG. 1.
Figure 9:
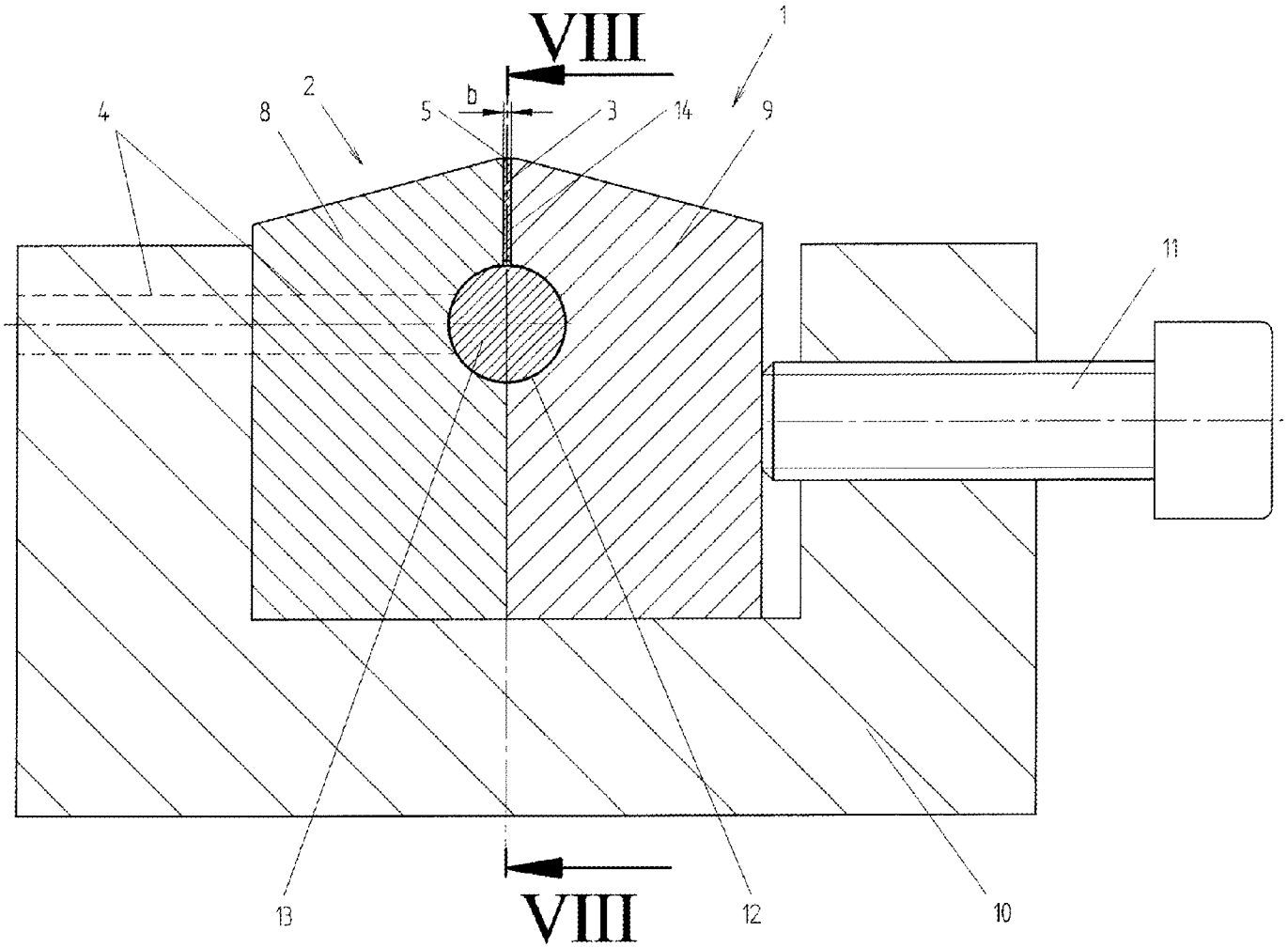
FIG. 9 shows a section through the slotted nozzle according to the line IX-IX in FIG. 8, corresponding to the sectional illustration with respect to the prior art in FIG. 3.

FIGS. 8 and 9 illustrate a first exemplary embodiment of the invention. The illustration of FIG. 9 corresponds here to that of FIG. 3. With regard to the basic construction of the slotted nozzle 1, reference is made to the above explanations regarding the slotted nozzle 1 according to the prior art in order to avoid repetitions. The nozzle body 2 according to the invention differs from that according to the prior art only by means of the special design of the tab 14 in the region of the end-side edge thereof facing the nozzle slot 3, i.e. the closing edge 21, and the end-side edge opposite the latter and therefore arranged on the other side of the nozzle slot 3, i.e. the closing edge 22, which closing edges are formed by the two nozzle parts 8, 9.

In FIGS. 8 and 9, in particular FIG. 8, the passage 4 and the bore 12, the plunger rod 13 with the tab 14, and the outlet opening 5 with the length l are visible. That end of the tab 14 which points toward the nozzle slot 3 and the outlet opening 5, i.e. the closing edge 21, has a curved shape. The closing edge 22 which is incorporated into the first and second nozzle parts 8, 9 and is opposite the end of tab 14 with the curved shape, i.e. the closing edge 21, likewise has a curved shape which is formed in a mirror-inverted manner with respect to the curved shape of the closing edge 21. The adhesive passes via the passage 4 into the bore 12 and flows from there through the nozzle slot 3, which is bounded between the closing edges 21, 22, toward the outlet opening 5 with the length l. By means of the flow cross section which becomes increasingly smaller from the bore 12 as far as the outlet opening 5, an increased emergence of adhesive arises at the two ends 6, 7 of the outlet opening 5. Said increased emergence of adhesive has the result that, with a slotted nozzle 1, used in the apparatus for gluing edges of a substrate on edge banders, the application of adhesive described above with respect to FIG. 6 with the over-increases 18, 19 in the adhesive can be realized.

Figure 10:
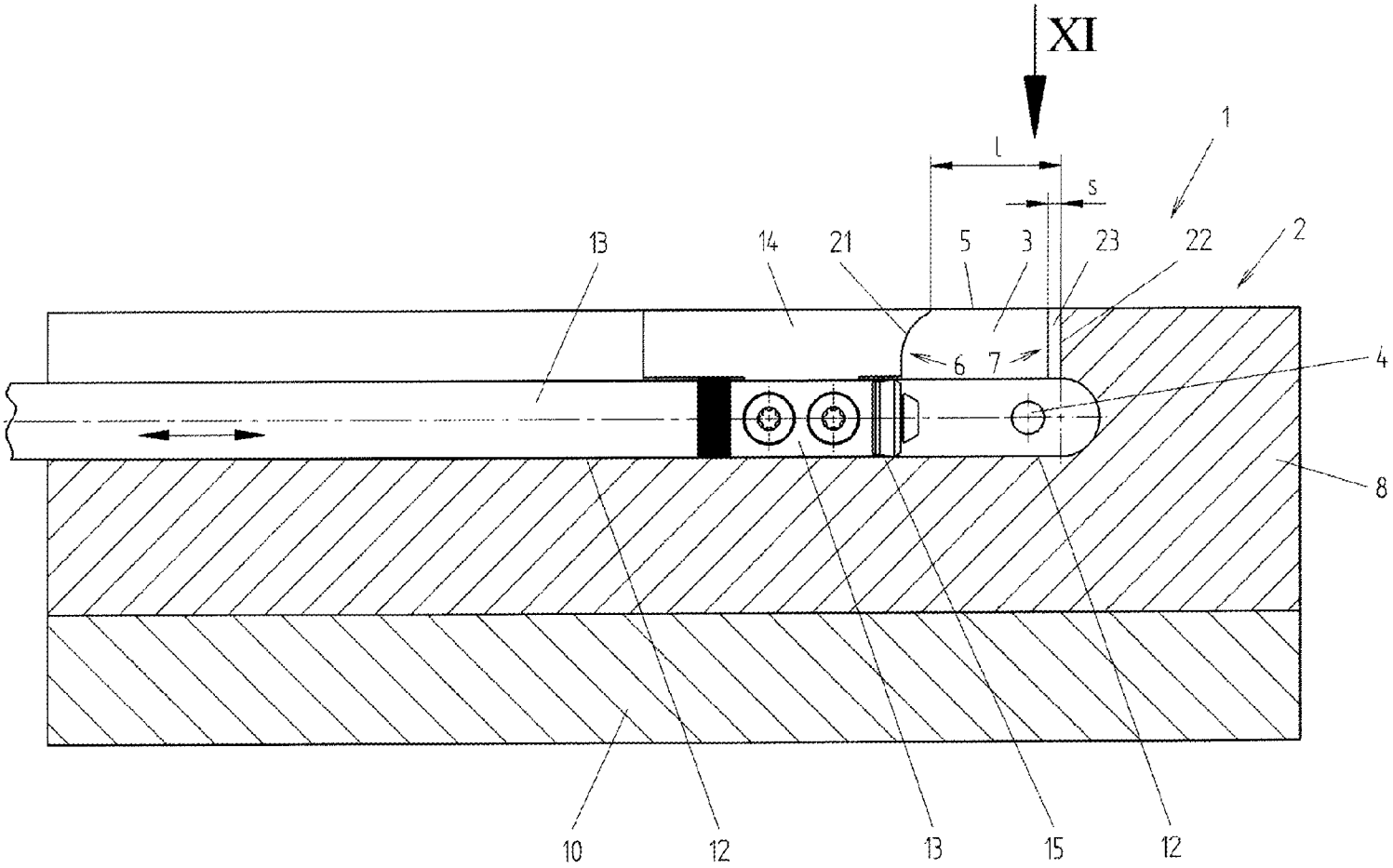
FIG. 10 shows a second exemplary embodiment of the slotted nozzle according to the invention in a sectional illustration according to the line VIII-VIII in FIG. 9.
Figure 11:
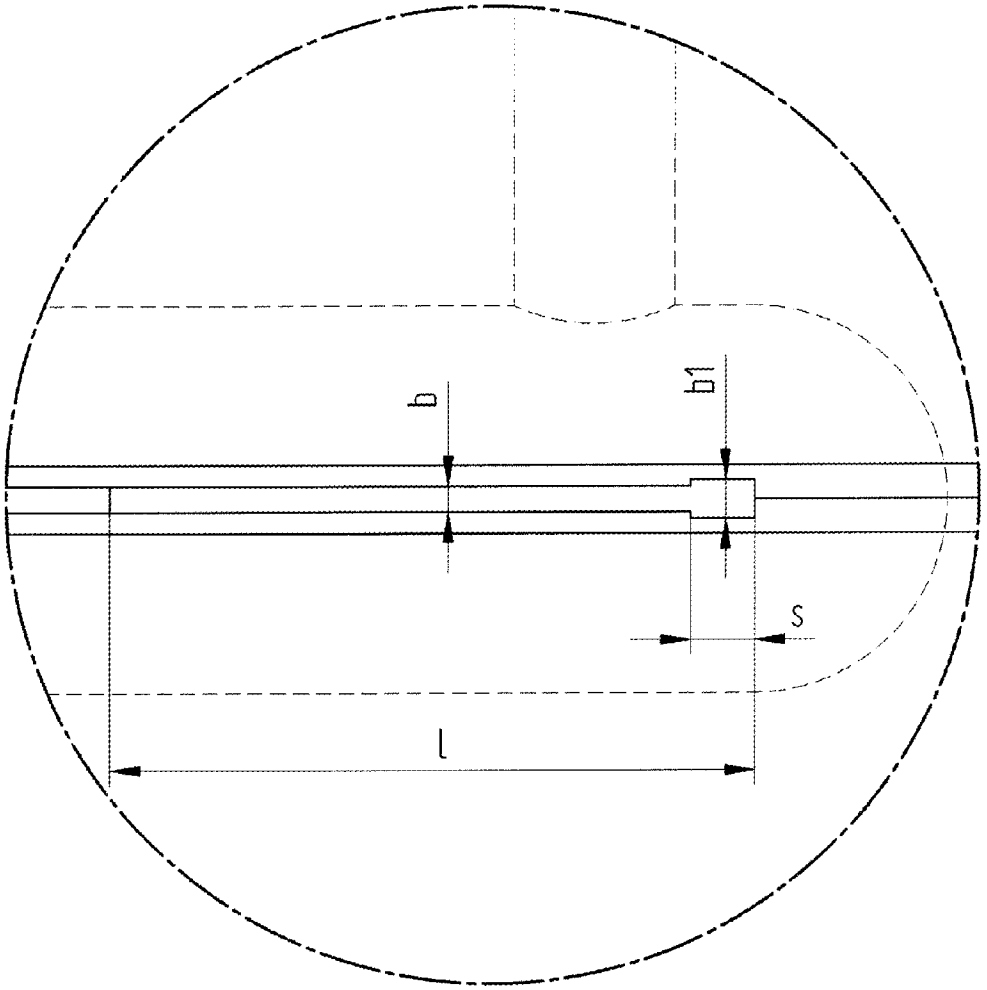
FIG. 11 shows a detailed view according to the arrow XI in FIG. 10.

In a second embodiment of the invention, which is illustrated in FIGS. 10 and 11, the tab 14 is designed with the closing edge 21 thereof in accordance with the first exemplary embodiment of the invention, and therefore has the curved shape. However, the other closing edge 22 is modified. It does not have a curved shape within the meaning of the curved shape of the closing edge 21, but rather the outlet opening 5 has a slightly greater width b1 in the region of the end 7 in comparison to the otherwise constant width b of the outlet opening. An increased emergence of the adhesive through the outlet opening 5 can therefore also take place in the region of this end 7. In this exemplary embodiment of the slotted nozzle 1, the closing edge 22 for the nozzle slot 3, through which adhesive can flow and which is incorporated in the first and/or the second nozzle part 8, 9 and which is opposite the tab 14, is a rectilinear groove 23 with an extent s toward the nozzle slot 3, thus resulting in the greater width b1 of the outlet opening 5. Said groove 23 can extend over the entire length of the closing edge 22. In principle, however, it is sufficient if the groove 23 is arranged in that region of the closing edge 22 which is adjacent to the outlet opening 5. The depth of the groove 23 is small here and is only a few percent of the width b of nozzle slot 3 and outlet opening 5, which width approximately corresponds to the thickness of the tab 14.

The rectilinear groove 23 does not have to be arranged at right angles to the bore 12, as depicted, but rather may also be formed inclined toward the nozzle slot 3 or the outlet opening 5. With a slotted nozzle 1 which has a tab 14 of curved shape and such a groove 23, which bound the slot of the outlet opening 5 having the length l, the increased ejection of adhesive at the ends 6, 7 of the outlet opening 5 can likewise be achieved. For the gluing of the edges of a substrate in edge banders, the above-described effect can also be realized with this solution. In particular, if the slotted nozzle 1 is not adjustable and accordingly a movable tab 14 is not required, the nozzle body can be designed in such a manner that it then has a groove in the region of the closing edge 21 of the nozzle body 2, the groove of the closing edge 21 being designed in accordance with the groove 23.

That which is claimed is:

1. A slotted nozzle for discharging a liquid adhesive to a narrow edge of a substrate, comprising:

a nozzle body;

a nozzle slot formed in the nozzle body;

a passage in the nozzle body for supplying the adhesive to the nozzle slot; and a slot-shaped outlet opening of the nozzle slot;

wherein the nozzle body is configured with averted ends of the nozzle slot that are based on the longitudinal extent of the nozzle slot in such a manner that an increased outlet of the adhesive through the outlet opening takes place in a region of the averted ends of the nozzle slot.

2. The slotted nozzle as claimed in claim 1, wherein the nozzle body forms closing edges in the region of the averted ends of the nozzle slot.

3. The slotted nozzle as claimed in claim 2, wherein, as a result of a reduction in a flow cross section of the nozzle body toward the outlet opening, which has a constant width, an increased outlet of the adhesive through the outlet opening in the region of the averted ends of the nozzle slot is produced.

4. The slotted nozzle as claimed in claim 3, wherein the nozzle body is configured in the region of the averted ends of the nozzle slot in such a manner that the flow cross section of the nozzle body is continuously reduced toward the outlet opening.

5. The slotted nozzle as claimed in claim 2, wherein the closing edges each have a non-linear shape.

6. The slotted nozzle as claimed in claim 5, wherein the closing edges have an identical shape arranged in a mirror-inverted manner.

7. The slotted nozzle as claimed in claim 2, wherein the outlet opening has a greater width extent in the region of the averted ends of the nozzle slot than in a remaining region of the outlet opening, which remaining region of the outlet opening has a constant width.

8. The slotted nozzle as claimed in claim 7, wherein the nozzle body has an expansion of the outlet opening in a region of the closing edges, the width of the outlet opening otherwise being constant.

9. The slotted nozzle as claimed in claim 2, wherein the nozzle body tapers toward the outlet opening in one of the region of the averted ends of the nozzle slot, and the outlet opening has a greater width in comparison to the outlet opening which has an otherwise constant width in the other region of the averted ends of the nozzle slot.

10. The slotted nozzle as claimed in claim 9, wherein the closing edges define a pair of closing edges and one of the pair of closing edges has a curved shape, and wherein the nozzle body has an expansion of the outlet opening in a region of the other closing edge, with the width of the outlet opening otherwise being constant.

11. The slotted nozzle as claimed in claim 1, wherein a length of the nozzle slot and the outlet opening is adjustable.

12. The slotted nozzle as claimed in claim 11, wherein the nozzle body has a basic body and an adjustment part, and wherein a length of the nozzle slot and the outlet opening is adjustable by the adjustment part which is mounted displaceably in the basic body and passes through the nozzle slot.

13. The slotted nozzle as claimed in claim 12, wherein a rod that is mounted displaceably in the basic body and is adjustable accommodates the adjustment part in a region of a free end of a plate-like tab.

14. The slotted nozzle as claimed in claim 12, wherein the adjustment part has a closing edge on a side of the adjustment part facing a region of the nozzle slot which receives the adhesive.

15. A slotted nozzle for discharging an adhesive, comprising:

a nozzle body;

a nozzle slot formed in the nozzle body;

a passage in the nozzle body for supplying the adhesive to the nozzle slot; and an outlet opening of the nozzle slot;

wherein the nozzle slot of the nozzle body has ends of a length of the nozzle slot that are configured such that an increased outlet of the adhesive through the outlet opening takes place at the ends of the nozzle slot; and wherein the outlet opening has a greater width at the ends of the nozzle slot than at an inner length of the outlet opening.

16. A slotted nozzle for discharging an adhesive, comprising:

a nozzle body;

a nozzle slot formed in the nozzle body;

a passage in the nozzle body for supplying the adhesive to the nozzle slot; and an outlet opening of the nozzle slot;

wherein the nozzle slot of the nozzle body has ends of a length of the nozzle slot that are configured such that an increased outlet of the adhesive through the outlet opening takes place at the ends of the nozzle slot; and wherein the nozzle body tapers toward the outlet opening at one of the ends of the nozzle slot, and the outlet opening has a greater width at the other end of the nozzle slot in comparison to an inner length of the outlet opening that is constant.

* * * * *